US005472740A

United States Patent [19]

Kubota et al.

[11] Patent Number: 5,472,740

[45] Date of Patent: Dec. 5, 1995

[54] PROCESS OF PRODUCING A HOT DIPPED WIRE FROM A BASE WIRE, WITH THE ABSENCE OF IRON-BASED, IRON OXIDE-BASED AND IRON HYDROXIDE-BASED MINUTE PARTICLES ON SURFACES OF THE BASE WIRE

[75] Inventors: Misao Kubota, Nagano; Yoshitada Hanai; Kouichi Otani, both of Ueda, all of Japan

[73] Assignee: Totoku Electric Co., Ltd., Tokyo, Japan

[21] Appl. No.: 770,685

[22] Filed: Oct. 3, 1991

[30] Foreign Application Priority Data

Oct. 11, 1990 [JP] Japan ..... 2-272895

[51] Int. Cl.[6] ..... B05D 3/02

[52] U.S. Cl. ..... 427/319; 427/329; 427/433

[58] Field of Search ..... 427/432, 433, 427/436, 319, 329, 434.6

[56] References Cited

U.S. PATENT DOCUMENTS

| | | | |
|---|---|---|---|
| 2,046,036 | 6/1936 | Rodrigues et al. . | |
| 2,120,496 | 6/1938 | Hauger . | |
| 2,689,641 | 9/1954 | Lips et al. . | |
| 3,692,578 | 9/1972 | Schreiner et al. | 427/319 |
| 3,782,909 | 1/1974 | Cleary et al. | 427/329 |
| 3,808,033 | 4/1974 | Mayhew | 427/433 |
| 4,053,663 | 10/1977 | Caldwell et al. | 427/432 |
| 4,111,026 | 9/1978 | Ford et al. . | |
| 4,143,184 | 3/1979 | Paulus et al. | 427/329 |

FOREIGN PATENT DOCUMENTS

| | | |
|---|---|---|
| 0216418 | 11/1987 | European Pat. Off. . |
| 0246418 | 11/1987 | European Pat. Off. . |
| 1272559 | 8/1961 | France . |

OTHER PUBLICATIONS

02–222505, Maejima et al (Japan) Sep. 5, 1990 (Abstract only).

"Patent Abstracts of Japan", unexamined applications, C. field, vol. 8, No. 273, Dec. 13, 1984, The Patent Office Japanese Government, p. 7 C 256, * Kokai–No. 59–143 057 *+Abstract+.

"Patent Abstracts of Japan", unexamined applications, C. field, vol. 8, No. 251 Nov. 16, 1984, The Patent Office Japanese Government, p. 79 C 252 * Kokai –No. 59–129 759 *+Abstract+.

*Primary Examiner*—Shrive Beck
*Assistant Examiner*—Katherine A. Bareford
*Attorney, Agent, or Firm*—Jordan and Hamburg

[57] ABSTRACT

A process of producing a hot dipped wire. During the wire drawing by the use of a water soluble lubricant, the base wire is passed over a passage surface made of a non-iron material. The drawn wire is heated in an atmosphere of a reducing gas for effectively removing an organic residue such as the lubricant and/or an oxide such as an iron oxide, inevitably adhered to the surface of the wire, and for annealing and for preheating the wire to accelerate a reaction between the wire and a molten hot dipping metal used in a subsequent hot dipping step.

6 Claims, 4 Drawing Sheets

PROCESS OF PRODUCING A HOT DIPPED WIRE FROM A BASE WIRE, WITH THE ABSENCE OF IRON-BASED, IRON OXIDE-BASED AND IRON HYDROXIDE-BASED MINUTE PARTICLES ON SURFACES OF THE BASE WIRE

BACKGROUND OF THE INVENTION

1. Field of the Invention

The present invention relates to a process of producing a hot dipped wire which is suitably used as a lead of an electronic component and a conductor of an electronic wiring, and more particularly but not exclusively relates to a process of fabricating a hot dipped tinned wire and a hot dipped solder plated wire.

2. Prior Art

A typical attempt of the conventional processes of producing hot dipped wires is illustrated in FIG. 5, in which a base wire to be plated undergoes wire drawing to produce a predetermine diameter wire 1' to be plated usually in a water soluble lubricant or an oil lubricant, using a wire drawing machine (not shown) including shoulder rollers, pulleys, a capstan, etc, all of which have wire passage surfaces made of iron materials. The drawn wire 1' to be plated is wound over a spool 2'. In the next step, the wire 1' to be plated which is unwound from the spool 2' is pulled through a steam annealing furnace 3' for annealing, and is then cleaned during traveling through a cleaning bath 5' using water 4'. Subsequently, the wire 1' to be plated is dried by heating in the dryer 6 to remove moisture on it, is passed through an acid flux bath 11 for acid cleaning the surface thereof, and is finally directly introduced with the acid flux adhering to it into a hot dipping metal bath 8, where the wire 1' to be plated makes contact with the molten metal for plating as well as cleaning the surface thereof. Then, the wire 1' to be plated passes through a drawing die d to produce a hot dipped wire 1'*a*.

Heretofore, iron materials were commonly used in shoulder rollers, pulleys, the capstan, etc of the wire drawing machine which define the wire drawing passage. For this reason, in the wire drawing step a trace amount of iron powder adheres to the surface of the wire 1' to be plated, which is then wound around a spool 2' with the iron powder adhered thereto. Furthermore, an iron spool is used as the spool 2'. Thus, the wire 1' to be plated is placed into contact with iron materials of the spool for a long period during of storage as well as during the wire drawing step.

Particularly, during the storage with the iron spool, the wire 1' to be plated is in contact with the iron materials of the body and the flange of the spool, and hence it is inevitable that iron oxides, such as an iron rust, adhere to the surface of the wire 1' to be plated. Such iron oxides provide very adverse influences in quality on the plated wire during the following hot dipping step. More specifically, the iron oxides adhering to the surface of the wire 1' to be plated change to iron hydroxides during travel in the steam annealing furnace 3' of the plating pretreatment step. When the wire 1' to be plated is introduced into the hot dipping bath 8, the iron hydroxides are decomposed to produce water, which is vaporized at once and dissipated from the surface of the wire 1' to be plated. As a result, nonplated portions are produced at surface portions of the wire 1' where the iron hydroxides had been adhered, and exposed surface portions are thus produced in the hot dipped wire.

Moreover, since the acid flux bath 11 is used in the plating pretreatment step, the acid is likely to scatter, and the acid flux adhered to the wire 1' to be plated is vaporized in the hot dipping bath 8 which is kept at a high temperature. These phenomena are liable to deteriorate or damage the equipment, and to pollute the working environment. Furthermore, the acid flux produces a metallic salt by reacting with the molten metal of the hot dipping bath, resulting in degradation of the hot dipping bath. Thus, the plating may also be deteriorated in quality.

SUMMARY OF THE INVENTION

Accordingly, it is an object of the present invention to provide a process of producing a hot dipped wire, which process is capable of producing a hot dipped wire having an excellent quality without exposed portions of the core wire.

It is another object of the present invention to provide a process of producing a hot dipped wire, which process is capable of reducing damages to the equipment, pollution of the working enviroment, and degradation of the plating.

In view of this and other objects, one aspect of the present invention is directed to a process of producing a hot dipped wire, comprising the steps of: wire drawing a base wire in a water soluble lubricant, using a wire drawing machine having a passage surface made of a material not providing iron oxide during the wire drawing, passing the base wire over the passage surface; winding the drawn wire around a spool having a surface made of a material not providing iron oxide, during the winding step, bringing the drawn wire in contact with the surface; pretreating the wire unwound from the spool, the pretreating step including: heating the wire in an atmosphere of a reducing gas to remove an organic residue and/or an oxide, inevitably adhered to the surface of the wire, through carbonization or reduction upon heating, and at the same time preheating the wire for annealing and accelerating a treatment with a molten metal in a subsequent step; and hot dipping the pretreated wire in the molted metal to obtain a hot dipped wire.

According to another aspect of the present invention, there is provided a process of producing a hot dipped wire, comprising the steps of: wire drawing a base wire in a water soluble lubricant, using a wire drawing machine having a passage surface made of a material not providing iron oxide, during the wire drawing, passing the base wire over the passage surface; pretreating the drawn wire from the wire drawing step, the pretreating step including: heating the wire in an atomsphere of a reducing gas to remove an organic residue and/or an oxide, inevitably adhered to the surface of the wire, through carbonization or reduction upon heating, and at the same time preheating the wire for annealing and accelerating a treatment with a molten metal in a subsequent step; and hot dipping the pretreated wire in the moltem metal to obtain a hot dipped wire.

The hot dipping step in each processes may suitably be effected immediately after the pretreating step.

DETAILED DESCRIPTION OF THE PREFERRED EMBODIMENTS

Several modes of this invention will be described hereinafter with reference to the accompanying drawings, but some of the description thereof is simplified or omitted since the steps of the present invention are similar to those of the prior art in many points except both the reducing gas heating in the pretreating step and the use of materials not providing iron oxide, in the wire passages. Conventional techniques relating to the present invention are disclosed in Japanese Patent Application Laying-Open Nos. Sho59-129759, Sho59-143057 and the Pamphlet issued by NIEHOFF (German company), for instance, which disclosures are incorporated herein by reference.

Figure 1:
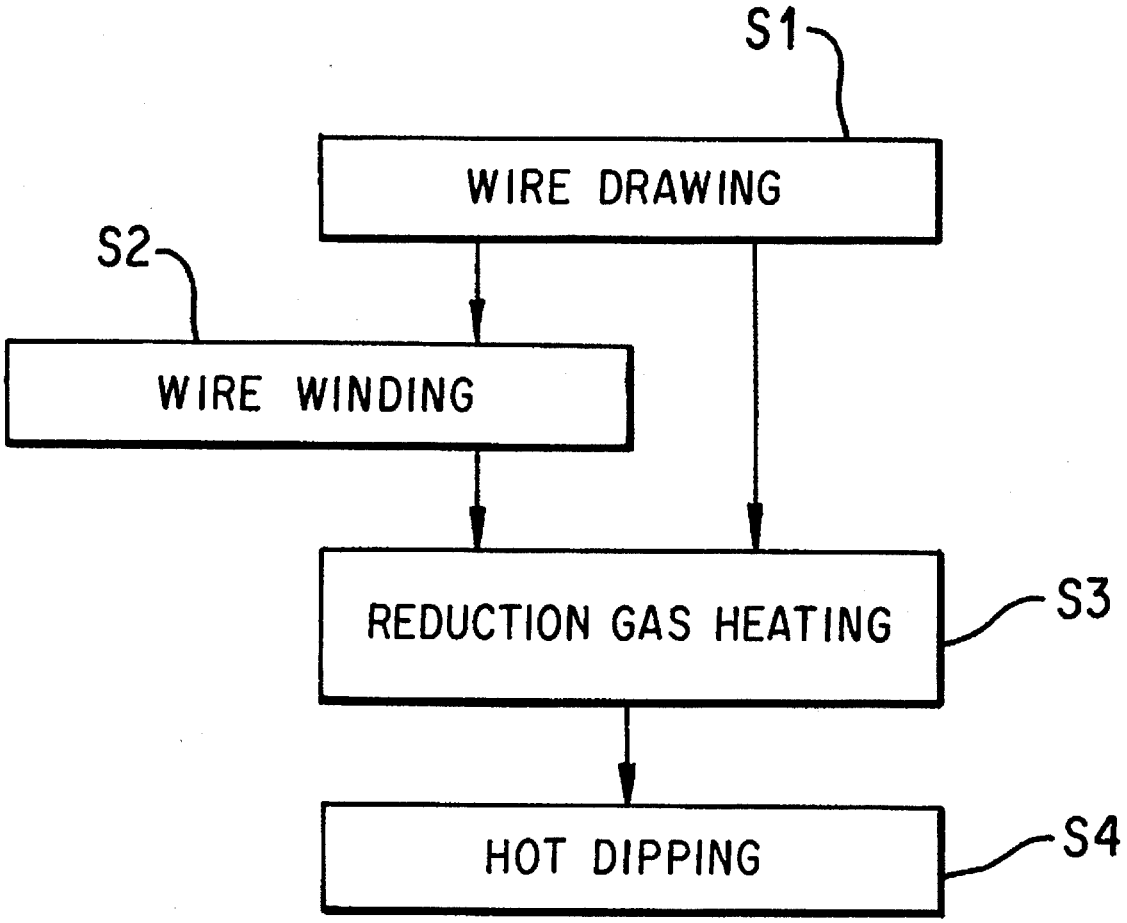
FIG. 1 is a block diagram showing two aspects of a process of producing a hot dipped wire according to the present invention.
Figure 2A:
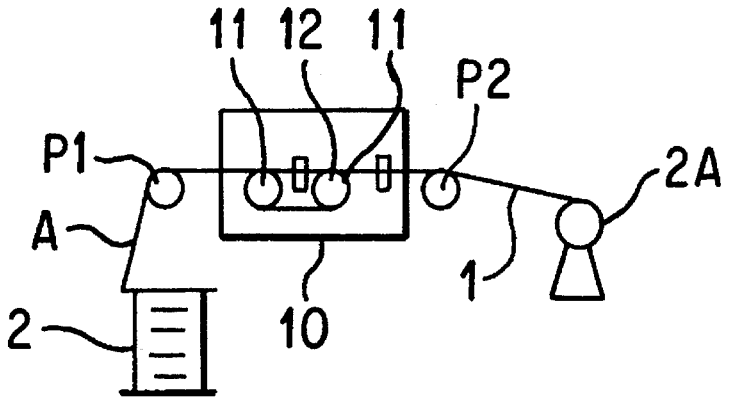
FIG. 2(*a*) and FIG. 2(*b*) are diagrammatic illustrations of a wire drawing step, and plating pretreatment and hot dipping steps according to the present invention, respectively.
Figure 2B:
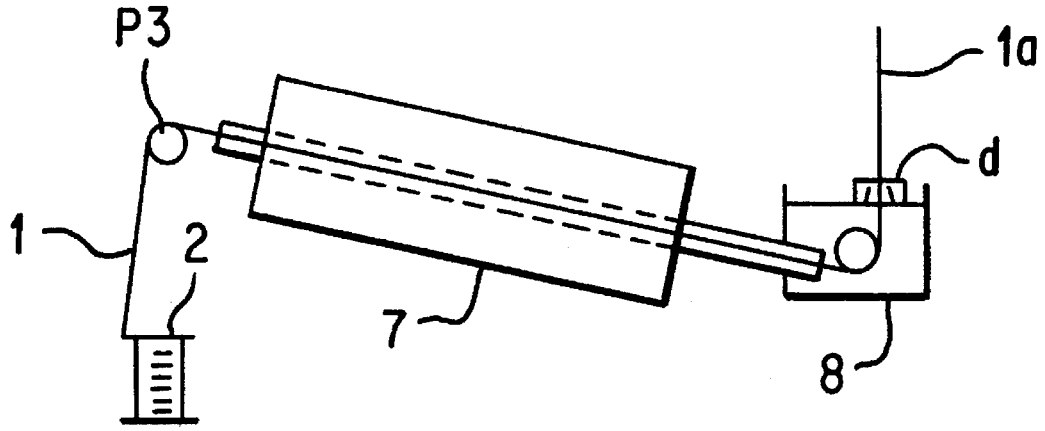

According to the present invention, as shown by the reference numeral S1 in FIG. 1 and in FIG.2, a base wire A such as a copper wire, is drawn in a commercially available water soluble lubricant ( for example, "LUBLITE #2000" 4.5% conc. NIHON YUZAI KENKYUSHO/Japanese company or "METALSYN N-321" 6% conc. KYOEISHA YUSHI KAGAKU KOGYO/Japanese company) into a predetermined diameter, using a wire drawing machine 10 shown in FIG. 2(*a*) including, for example, shoulder rollers step rolls 11, a dice 12, pulleys and a capstan all of which were coated with a material not providing an iron oxide, such as a ceramic or plastic material, for contact with the base wire.

As shown by the reference numeral S2 in FIG. 1 and in FIG. 2(*a*), the wire 1 thus drawn may be from a spool 2A and wound around a spool 2 which surfaces are coated with a ceramic or plastic material (for example, epoxy resin or the like) for contact with the wire 1, and may be then stored with its surface free of any iron powder and any iron oxide adhered to it.

Non-iron materials other than the above may be used as or for the shoulder rollers, the pulleys (P1, P2, P3), the capstan and the spool, for not providing an iron oxide on the wire's surface.

After the wire winding step S2, as indicated by the reference numeral S3 in FIG. 1 and in FIG. 2(*b*), the wire 1 to be plated is pulled at a speed of about 50 to 90 m/min, typically 70 m/min, and is directly introduced into a tunnel furnace 7, for example 2 m long, in the atmosphere of a reducing gas typically at about 300° to 500° C. (pretreating step).

Figure 3:
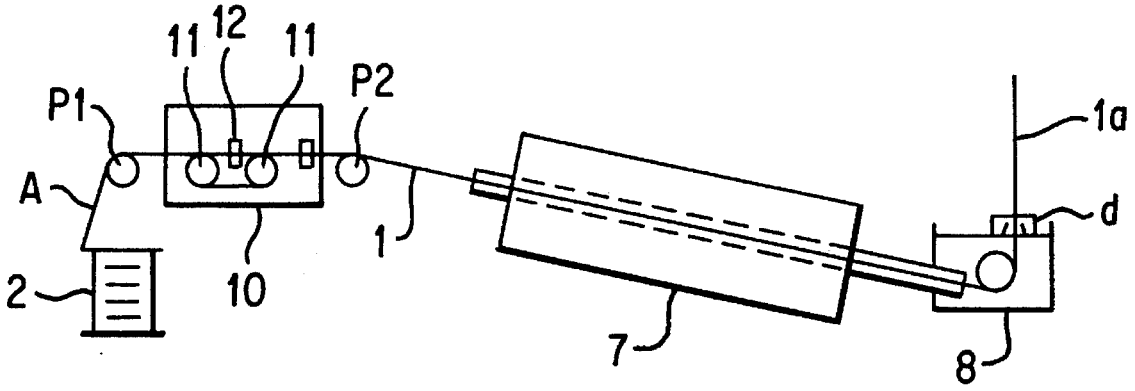
FIG. 3 is a diagrammatic illustration of another aspect of the present invention.

Alternatively, after the wire drawing step S1, the wire 1 is, as shown in FIG. 3, unwound from the spool 2, and is fed to the tunnel furnace 7 under the same conditions.

Specific examples of the reducing gas include a carbon monoxide gas, a hydrogen gas and the mixture thereof. The reducing gas may be used as admixed with a suitable inert gas not causing oxidation during the pretreating step. Examples of the inert gas includes a nitrogen gas and an argon gas.

In the furnace 7, the wire 1 to be plated is treated with the reducing gas under such a high temperature. During the treatment, an organic residue such as a water soulble lubricant or the like, which may inevitably be brought into the furnace with the wire as adhering to the surface thereof, will convert to carbonaceous materials mainly by heating to be easily removed from the wire through the furnace. Further, an oxide such as an iron oxide or copper oxide, which may also be adhered to the surface of the wire, will be reduced to convert to a volatile product to be removed from the wire in the furnace. As a result, the wire 1 is completely cleaned to remove any undesirable contaminants or layer from the surface.

Moreover, in the pretreating step, the wire 1 is suitably preheated by annealing itself as well as for accelerating the subsequent hot dipping treatment.

Thereafter, as indicated by the reference numeral S4 in FIG. 1 and in FIG. 2(*b*), the wire 1 is introduced into a hot dipping bath 8, such as a tinning bath and a soldering bath, where a molten metal is adhered to the wire 1, which is then passed through a drawing die d, provided just above the hot dipping bath 8 for drawing the molten metal adhering to the wire 1 so as to provide a molten metallic plating with a predetermined thickness over the wire 1. Then, the wire 1 is introduced into the atmosphere to cool and solidify the plating layer, so that a hot dipped wire 1*a* is fabricated.

The surfaces, on which the wire passes, from the wire drawing step S1 to the hot dipping step S4 may be protected by a material not providing iron oxide, for example a conventional non-iron material such as a ceramic and a plastic. As a result, the copper wire 1 is hot dipped substantially with no contaminants adhered and no oxidized layer or materials, and thus a hot dipped tinned wire 1*a* having excellent quality may be fabricated without any exposed core surface.

EXAMPLE 1

A copper base wire A with a diameter 2.6 mm, as illustrated in FIG. 2(*a*), was drawn in a water soluble lubricant into a 0.3 mm diameter copper 1 wire to be plated, using a wire drawing machine 10 including shoulder rollers, pulleys and a capstan all of which were made of a ceramic for contact with the base wire. The copper wire 1 thus drawn was wound around a spool 2 which surfaces were coated with a plastic for contact with the wire, and was thus stored with its circumferential surface free of any iron powder and any iron oxide adhered to it. Then, as shown in FIG. 2(*b*), the copper wire 1 to be plated was unwound from the spool 2 at a speed of 70 m/min, and was pulled through a 2 m long tunnel furnace 7 in the atmosphere of a carbon monoxide gas (reducing gas) at 500° C. The temperature of the furnace was 300° C. at each of the inlet and outlet thereof.

In the furnace 7, the copper wire 1 to be plated was cleaned with the reducing gas and heated so that a trace amount of the water soluble lubricant or other organic substances and an oxide layer could be easily removed, through carbonization and reduction producing CO2 gas, from the surface of the wire 1. Simultaneously, the wire 1 was annealed and heated at a suitable temperature for effectively conducting the subsequent hot dipping step. In such a state, the wire 1 was introduced into a hot dipping tinning bath 8 which had been heated at 260° C., where a molten tin was adhered to the wire 1, which was then passed through a drawing die d, provided just above the hot dipping bath 8 for drawing the molten tin adhering to the wire 1 so as provide about a 5 μm thick molten tin plating over the wire 1.

Then, the wire 1 was introduced into the outer atmosphere to cool and solidify the plating layer, so that a hot dipped tinned wire 1*a* was fabricated. The surfaces, on which the wire passed, from the wire drawing step to the hop dipping step were coated with a non-iron material such as a ceramic and a plastic. As a result, the copper wire 1 was hot dipped with little impurities adhered and little oxidized layer, and thus a hot dipped tinned wire 1*a* have excellent quality was fabricated without any exposed core surface.

EXAMPLE 2

As illustrated in FIG. 3, wire drawing step S1, plating pretreatment S3 and hot dipping step S4 were conducted in a continuous line.

According to the same conditions as in the wire drawing step of Example 1, a 2.6 mm diameter copper base wire A to be plated was drawn by the same wire drawing machine as in Example 1 into a 0.3 mm diameter copper wire 1, which was continuously introduced into the tunnel furnace 7 used in Example 1 without having been wound around a spool. The subsequent steps were conducted in the same conditions as in Example 1, and thereby a hot dipped tinned wire 1*a* was produced. Also in this example, the wire 1 was pulled at a speed of 70 m/min. The surfaces, on which the wire passed, from the wire drawing step to the hop dipping step were also coated with a non-iron material such as a ceramic and a plastic. The hot dipped tinned wire 1*a* fabricated in Example 2 was also excellent in appearance without any exposed core wire surface.

EXAMPLE 3

Figure 4:
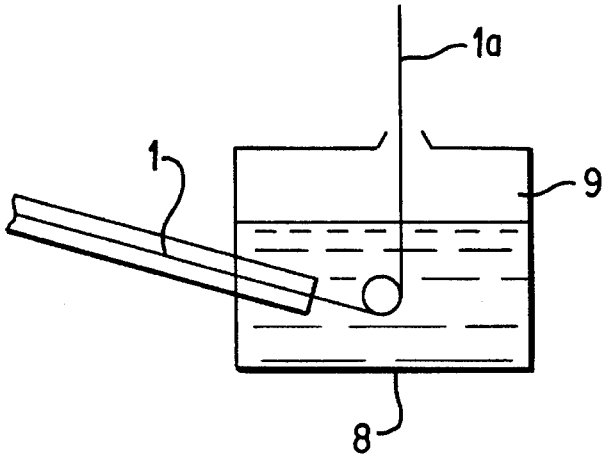
FIG. 4 is a diagrammatic illustration of a modified form of the hot dipping bath of FIG. 3.
Figure 5:
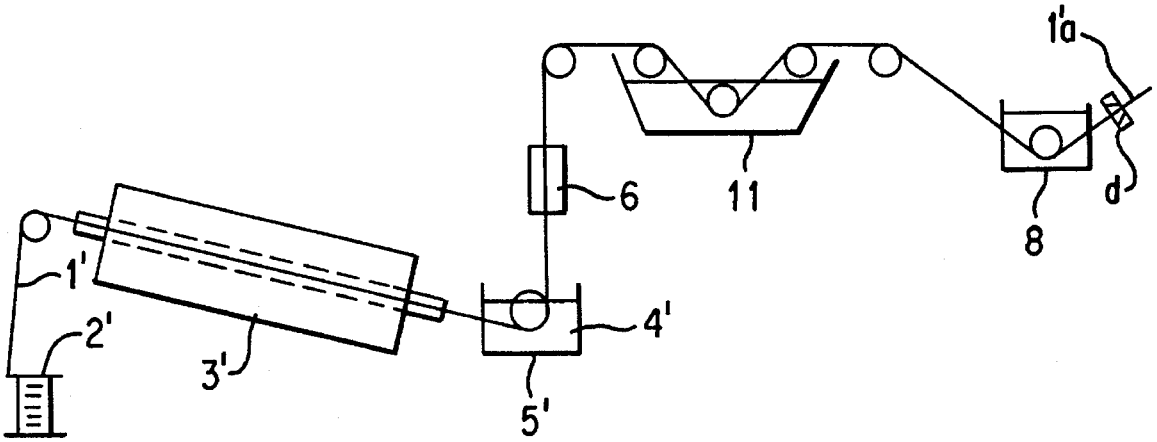
FIG. 5 is a diagrammatic illustration of the conventional process of producing a hot dipped wire.

As shown in FIG. 3 and FIG. 4, wire drawing step S1, plating pretreatment S3 and hot dipping step S4 were conducted in a continuous line as in Example 2 although no drawing die d was used in the hot dipping step S4.

As a base wire A to be plated a 2.6 mm diameter oxygen free copper (OFHC) wire was used, and was drawn into a 0.46 mm diameter OFHC wire 1 according to the same conditions as in the wire drawing step using the same wire drawing machine 10 of Example 1. Then, without having been wound on a spool, the OFHC wire 1 was continuously passed through a 2 m long gas reducing furnace 7 in the atmosphere of a nitrogen gas containing 10 volume % of hydrogen gas at a set temperature of 500° C., so that the organic residue and the oxide layer on the wire 1 was removed by carbonization and reduction with the wire 1 annealed and preheated. The OFHC wire preheated was, as shown in FIG. 4, introduced into a hot dipping bath 8 at a set temperature 260° C. After being dipped in the molten tin, the OFHC wire 1 was drawn out vertically upwardly, so that the OFHC wire 1 was tinned without using any drawing die. In this event, the OFHC wire 1 vertically passed through a CO containing non-oxidizing atmosphere chamber 9 which was spatially placed to contact the level of the molten tin. This uniformly controlled the thickness of the plating adhered to the OFHC 1, and then the wire 1 was introduced into the atmosphere to cool and solidify the plating layer. The hot dipped tinned wire 1*a* thus produced had a 12 μm thick plating. In this example, the wire 1 was pulled at a speed of 30 m/min. Also, in this example, the surfaces, on which the wire 1 passed, from the wire drawing step S1 to the hot dipping step S4 were coated with a non-iron material such as a ceramic and a plastic as in Example 1.

The hot dipped wire 1*a* obtained was excellent in appearance without any exposed core wire and with a uniform plating.

What is claimed is:

1. A process of producing hot dipped wire, comprising the steps of:

wire drawing a base wire, said base wire made of a material selected from the group consisting of copper and copper alloy, in a water soluble lubricant by means of a wire drawing machine to obtain a wire to be plated;

winding the wire to be plated around a spool;

pretreating the wire to be plated, the step of pretreating including the steps of:

unwinding the wire to be plated from said spool, running the wire to be plated through a heating furnace with a reducing gas atmosphere therein to carbonize the water soluble lubricant and other impurities deposited on a surface of the wire to be plated in said wire drawing step and to also remove oxides on the surface of the wire to be plated, and preliminarily heating the wire to be plated to promote annealing and reaction of the wire to be plated with a molten material selected from the group consisting of tin and tin-alloy for hot dipping;

hot dipping the wire to be plated with said molten material selected from the group consisting of tin and tin-alloy, wherein the hot dipping step is directly connected to said step of running the wire through a heating furnace with a reducing gas atmosphere therein; and wherein the improvement comprises the step of:

providing a passage along which the base wire and the wire to be plated is passed, in all of the steps before the hot dipping step, so as to inhibit physical deposition of iron-based, iron oxide-based and iron hydroxide-based minute particles on surfaces of the base wire and the wire to be plated and on surfaces of the passage contacted by the base wire and the wire to be plated.

2. A process according to claim 1, wherein said passage surfaces include a spool over which the base wire is wound, a spool over which the wire to be plated is wound, an internal wall of the heating furnace, and guide pulleys.

3. A process according to claim 1, wherein said heating furnace has a length in the range of approximately 1 to 3 meters, and said step of running the wire to be plated through a heating furnace with a reducing gas atmosphere therein includes the step of passing the wire to be plated through the furnace at a speed in the range of approximately 50 to 90 m/min under a temperature in the range of about 300° to 500° C.

4. A process of producing hot dipped wire, comprising the steps of:

wire drawing a base wire, said base wire made of a material selected from the group consisting of copper and copper alloy, in a water soluble lubricant by means of a wire drawing machine to obtain a wire to be plated;

pretreating the wire to be plated, the step of pretreating including the steps of:

continuously guiding the wire to be plated frown said wire drawing step through a heating furnace with a reducing gas atmosphere therein to carbonize the water soluble lubricant and other impurities deposited on a surface of the wire to be plated in said wire drawing step and to also remove oxides on the surface of the wire to be plated, and preliminarily heating the wire to be plated to promote annealing and reaction of the wire to be plated with a molten material selected from the group consisting of tin and tin-alloy for hot dipping;

hot dipping the wire to be plated with said molten material selected from the group consisting of tin and tin-alloy, wherein the hot dipping step is directly connected to said step of continuously guiding; and wherein the improvement comprises the step of:

providing said passage along which the base wire and the wire to be plated are passed, in all of the steps before the hot dipping Step, so as to inhibit physical deposition of iron-based, iron oxide-based and iron hydroxide-based minute particles on surfaces of the base wire and the wire to be plated and on surfaces of the passage contacted by the base wire and the wire to be plated,

5. A process according to claim 4, wherein said passage surfaces are made of a material selected from the group consisting of ceramic and resin.

6. A process according to claim 4, wherein said heating furnace has a length in the range of approximately 1 to 3 meters, and said step of continuously guiding includes the step of passing the wire to be plated through the furnace at a speed in the range of approximately 50 to 90 m/min under a temperature in the range of about 300° to 500° C.

* * * * *